US006031325A

United States Patent [19]

Amano

[11] Patent Number: 6,031,325

[45] Date of Patent: Feb. 29, 2000

[54] ELECTRON GUN FOR IN-LINE COLOR CATHODE RAY TUBE HAVING DIFFERENTLY SHAPED ELECTRON BEAM PASSAGE APERTURES

[75] Inventor: Yasunobu Amano, Tokyo, Japan

[73] Assignee: Sony Corporation, Japan

[21] Appl. No.: 08/881,465

[22] Filed: Jun. 24, 1997

[30] Foreign Application Priority Data

Jul. 3, 1996 [JP] Japan ..... 8-192891

[51] Int. Cl.[7] ..... H01J 29/48

[52] U.S. Cl. ..... 313/412; 313/414

[58] Field of Search ..... 313/412, 413, 313/414, 447, 448, 449, 411; 315/382, 368, 371

[56] References Cited

U.S. PATENT DOCUMENTS

| | | | |
|---|---|---|---|
| 2,834,911 | 5/1958 | Nelson | 313/412 |
| 4,704,565 | 11/1987 | Blacker, Jr. et al. | 313/412 |
| 5,027,043 | 6/1991 | Chen et al. | 313/412 |
| 5,113,112 | 5/1992 | Shimona et al. | 313/412 |

FOREIGN PATENT DOCUMENTS 0720 203 A1 3/1996 European Pat. Off. .

2 154 789 11/1985 United Kingdom .

*Primary Examiner*—Vip Patel
*Assistant Examiner*—Joseph Williams
*Attorney, Agent, or Firm*—Ronald P. Kananen; Rader, Fishman & Grauer

[57] ABSTRACT

A focus electrode of an electron gun for color cathode ray tubes of the present invention is divided into at least two focus electrodes, three electron beam passage apertures are provided on each focus electrode, electron beam passage apertures disposed on the one end sides of at least one focus electrodes have different astigmatism respectively from electron beam passage apertures disposed on the other end sides, electron beam passage apertures disposed on both sides of the focus electrode have different astigmatism from electron beam passage apertures disposed on both sides facing each other of the adjacent focus electrodes, the electron beam passage apertures disposed at the center of the respective focus electrodes are shielded. The invention provides an in-line three beam type electron gun for color cathode ray tubes which is capable of equalizing the beam spot configuration of three electron beams on the right and left ends of the fluorescent screen.

10 Claims, 15 Drawing Sheets

(VARIATION PATTERN OF $V_{DQ}$: REFER TO FIG.3A)

QUADRUPOLE ACTION EXERTED ON ELECTRON BEAM BY MEANS OF FOCUS ELECTRODE

| ELECTRON BEAM | B | G | R |
|---|---|---|---|
| IN THE CASE OF THE STATE [a] | VERTICAL DIRECTION | NONE | HORIZONTAL DIRECTION |
| IN THE CASE OF THE STATE [b] | HORIZONTAL DIRECTION | NONE | VERTICAL DIRECTION |

(VARIATION PATTERN OF $V_{DQ}$ : REFER TO FIG.3B)

QUADRUPOLE ACTION EXERTED ON ELECTRON BEAM BY MEANS OF FOCUS ELECTRODE

| ELECTRON BEAM | B | G | R |
|---|---|---|---|
| IN THE CASE OF THE STATE [a] | VERTICAL DIRECTION | NONE | HORIZONTAL DIRECTION |
| IN THE CASE OF THE STATE [b] | HORIZONTAL DIRECTION | NONE | VERTICAL DIRECTION |

ELECTRON GUN FOR IN-LINE COLOR CATHODE RAY TUBE HAVING DIFFERENTLY SHAPED ELECTRON BEAM PASSAGE APERTURES

BACKGROUND OF THE INVENTION

1. Field of the Invention

This invention relates to an in-line three beam type electron gun for color cathode ray tubes used for color cathode ray tubes which are components, for example, of color kinescopes and color display apparatus.

2. Description of Related Art

In general, the resolution characteristics of a color cathode ray tube depends greatly on size and configuration of an electron beam spot on the fluorescent screen. In detail, good resolution cannot be obtained unless the spot diameter of such electron beam is small and approximately completely round.

The path of an electron beam from an electron gun for a cathode ray tube to a fluorescent screen becomes longer when increasing in deflection angle of the electron beam. Therefore, a focus voltage is maintained so that an electron beam spot having a small diameter and complete round is obtained at the center of the fluorescent screen, such focus voltage results in an over focus at the peripheral portion. As a result, a beam spot having a small diameter and completely round can not be obtained around the peripheral portion, and good resolution can not be obtained.

To meet the recent requirement for wide deflection angle of an electron beam, the dynamic focus type electron gun for cathode ray tube, in which a high focus voltage is applied to an electron beam which impinges on the periphery of the fluorescent screen to suppress the main lens function has been developed. However, the dynamic focus type is not suitable for the in-line three beam type electron gun for cathode ray tube as it is. In detail, in the case that the deflection magnetic field of a deflection yoke is uniform in a conventional in-line three beam type electron gun for a cathode ray tube having three cathodes arranged on a horizontal straight line, though an electron beam is converged at the center of the fluorescent screen, but such uniform magnetic field leads to vertical-bow-shape convergence error (over convergence) on the top, bottom, right, and left periphery of a fluorescent screen as shown in FIG. 17. In FIG. 17, R (red) and B (blue) represent both side electron beams and G (green) represents the central electron beam. The same is true in the description hereinafter.

Therefore, heretofore the dynamic convergence has been performed with horizontal deflection magnetic field distribution by means of a deflection yoke in shape of a pincushion and with vertical deflection magnetic field distribution in shape of a barrel. However, in the case of a deflection yoke having such structure, an electron beam, which passes through a yoke and is deflected toward the periphery of the fluorescent screen, receives convergence action (convex lens effect) in the perpendicular direction (vertical direction) and, on the other hand, receives divergence action (concave lens effect) in the horizontal direction (parallel direction). As the result, an electron beam forms not a complete round spot but a horizontal elliptical spot on the periphery of the fluorescent screen. Therefore, a deformed spot of an electron beam and poor focusing performance on the periphery of the fluorescent screen are a problem.

To solve such problem, for example, Japanese Patent Laid-Open No. Sho 61-99249, Japanese Patent Laid-Open No. Sho 62-237642, and Japanese Patent Laid-Open No. Hei 3-93135 disclose electron guns for cathode ray tubes incorporated with a so-called electrostatic quadrupole lens (refer to simply as quadrupole lens hereinafter).

FIG. 13A is a conceptual diagram of an electron gun for color cathode ray tube having a built-in quadrupole lens which is used popularly. In this electron gun for color cathode ray tubes, a certain focus voltage $V_F$ is applied to the $5_{-1}$ electrode 51 through a stem. On the other hand, a superimposed voltage ($V_F$+$V_{DF}$) comprising a dynamic focus voltage $V_{DF}$ (refer to FIG. 8) which is synchronous with horizontal deflection of the focus voltage $V_F$ and the focus voltage $V_F$ is applied to the third electrode 13 and $5_{-2}$ electrode 52. Thereby a quadrupole lens is formed between the $5_{-2}$ electrode 52 and the sixth electrode 16, and the focus lens formed between the $5_{-2}$ electrode 52 and the sixth electrode 16 is varied in strength. As the result, the shape of an electron beam on the periphery in the right-left direction of the fluorescent screen is improved. On the face of the $5_{-1}$ electrode 51 which is facing to the $5_{-2}$ electrode 52, a plate 151 on which vertical electron beam apertures 151A, 151B, and 151C are formed as shown in FIG. 13B is provided. On the other hand, on the face of the $5_{-2}$ electrode 52 which is facing to the $5_{-1}$ electrode 51, a plate 152 on which horizontal electron beam apertures 152A, 152B, and 152C are formed as shown in FIG. 13C is provided.

Further, FIG. 13D is a conceptual diagram of an electron gun for color cathode ray tubes having a built-in quadrupole lens which is used popularly. In this electron gun for color cathode ray tubes, a certain focus voltage $V_F$ is applied to the $5_{-2}$ electrode 52 through a stem. On the other hand, a superimposed voltage ($V_F$ and $V_{DF}$) comprising a dynamic focus voltage $V_{DF}$ (refer to FIG. 8) which is synchronous with horizontal deflection of the focus voltage $V_F$ and the focus voltage $V_F$ is applied to the third electrode 13, $5_{-1}$ electrode 51, and $5_{-3}$ electrode 53. Thereby quadrupole lenses which act inversely each other are formed between the $5_{-1}$ electrode 51 and $5_{-2}$ electrode 52 and between the $5_{-2}$ electrode 52 and $5_{-3}$ electrode 53, and a focus lens formed between the $5_{-3}$ electrode 53 and the focus lens formed between the $5_{-3}$ electrode 53 and the sixth electrode 16 is varied in strength. As the result, the shape of an electron beam on the periphery in the right-left direction of the fluorescent screen is more improved. On the plane of the $5_{-1}$ electrode 51 which is facing to the $5_{-2}$ electrode 52 and on the plane of the $5_{-2}$ electrode 52 which is facing to the $5_{-3}$ electrode 53, plates 151 on each of which vertically long electron beam apertures 151A, 151B, and 151C are formed as shown in FIG. 13B are provided. On the other hand, on the plane of the $5_{-2}$ electrode 52 which is facing to the $5_{-1}$ electrode 51 and on the plane of the $5_{-3}$ electrode 53 which is facing to the $5_{-2}$ electrode, plates 152 on each of which horizontally long electron beam apertures 152A, 152B, and 152C are formed as shown in FIG. 13C are provided.

By providing quadrupole lenses, as an electron beam approaches the end in the horizontal direction of a fluorescent screen, the electron beam receives divergent action (concave lens effect) in the perpendicular direction (vertical direction) and, on the other hand, receives convergent action (convex lens effect) in the horizontal direction (parallel direction). As the result, the electron beam forms a nearly complete round spot on the periphery of the fluorescent screen.

A quadrupole lens exhibits significant effect. In the prior art disclosed in the above-mentioned Japanese Patent Applications Laid-Open, the quadrupole is effective on three electron beams equally. However as shown in the conceptual diagram of FIG. 14, three electron beams which are emitted from an electron gun and impinge on the right and left periphery of a fluorescent screen are different each other in the position in a magnetic field of a deflection yoke 2 which these electron beams pass through. As the result, three electron beams receive convergent action and divergent action in the magnetic field of the deflection yoke differently in the magnitude of the actions. Therefore, three electron beams form spots distorted differently each other in extent on the right and left periphery of the fluorescent screen 4. In FIG. 14, the reference number 3 represents a glass bulb.

Usually the focus voltage is adjusted so that the center electron beam (G) out of three electron beams forms an electron beam spot of desired shape. In this case, when three electron beams impinge on the right side of the fluorescent screen 4, the electron beam R receives action of the deflection magnetic field formed by the deflection yoke 2 more intensely than the electron beam G and the electron beam B. As the result, the electron beam R forms a beam spot on the fluorescent screen 4 distorted more seriously than other electron beams. On the other hand, when three electron beams impinge on the left side of the fluorescent screen 4, the electron beam B receives action of the deflection magnetic field formed by the deflection yoke 2 more intensely than the electron beam G and the electron beam R. As the result, the electron beam B forms a beam spot on the fluorescent screen 4 distorted more seriously than other electron beams. Schematic electron beam spots on the fluorescent screen 4 are shown in FIGS. 15A and 15B. FIG. 15A shows the electron beam spots obtained when an electron gun for color cathode ray tubes having one set quadrupole lens structure shown in FIG. 13A is used. On the other hand, FIG. 15B shows the electron beam spots obtained when an electron gun for color cathode ray tubes having two set quadrupole lens structure shown in FIG. 13D is used. The electron beam spots obtained when an electron gun for color cathode ray tubes having two sets of quadrupole lens structures is more improved than the electron beam spots obtained when an electron gun for color cathode ray tubes having one set of quadrupole lens structures.

In some recent large size color display monitor having high resolution, red characters formed on the right side of the fluorescent screen 4 is unclear, and blue characters formed on the left side of the fluorescent screen 4 is unclear.

As one method to solve such problem, a method that the diameter of an electron beam is minimized at the center of a magnetic field of a deflection yoke 2 has been known. In detail, by minimizing the diameter of an electron beam at the center of a magnetic field of a deflection yoke, the effect of a magnetic field of a deflection yoke 2 on the electron beam dependent on the position through which the electron beam passes is suppressed as small as possible.

The diameter of a beam spot of an electron beam at the center of a fluorescent screen is calculated using the equation (1) described herein under.

$$\text{Beam spot diameter}=\{(M\times d_c+M\times C_s\times\theta^3/2)^2+\Delta d_{rep}^{\ 2}\}^{1/2} \quad \ldots (1)$$

Wherein M represents an image multiplication factor, $d_c$ represents an imaginary object spot diameter (diameter of cross-over), $C_s$ represents a spherical aberration coefficient, θ represents a divergent angle of an electron beam incident to the main focus lens, and $\Delta d_{rep}$ represents a diameter increment (repulsion) due to mutual repulsion of electrons. Assuming that a voltage of the third electrode 13 is V, the following equation (2) holds.

$$d_c\theta\times V^{1/2}=\text{constant} \quad \ldots (2)$$

FIG. 16 shows schematic and optical focusing of an electron beam emitted from an imaginary object point (X) on a fluorescent screen by means of a main focus lens formed between the fifth electrode and sixth electrode. The focusing represented by a solid line [A] in FIG. 16 represents the focusing when the minimized beam spot diameter of an electron beam in the equation (1) is obtained. The focusing represented by a dotted line [B] represents the focusing when the image multiplication factor M is low, that is, when the electron beam is emitted from an imaginary object point (Y) positioned farther than the imaginary object point (X). Further, the focusing represented by a dashed line [C] represents a focusing when the electron beam is focused with a smaller divergent angle θ than the divergent angle for minimizing the beam spot diameter of an electron beam in order to minimize the diameter of the electron beam at the center of the magnetic field of the deflection yoke 2.

In the focusing shown with the dashed line [C], because the diameter of the electron beam at the center of the magnetic field of the deflection yoke 2 is minimized, the adverse effect of the magnetic field of the deflection yoke 2 on the electron beam, which depends on the position through which the electron beam passes, is reduced. However, because the equation (2) holds between the imaginary object point diameter $d_c$ and divergent angle θ, this focusing involves a problem that the beam spot diameter of an electron beam on the fluorescent screen 4 is larger than that of the focusing shown with a solid line [a].

For example, in a current 20 inch type color display monitor, the difference between the focus voltage that is required to obtain beam spots of electron beams R, G, and B shown in FIG. 15A and the focus voltage that is required to equalize the beam spot of the electron beam R on the right end of the fluorescent screen 4 to the beam spot of the electron beam G shown in FIG. 15A is as high as about 100 V. Naturally, as the shape of the beam spot of the electron beam R at the right end of the fluorescent screen 4 is equalized to the shape of the beam spot of the electron beam G, the shape of the beam spot of the electron beam G is degraded. Therefore, minimization of the electron beam diameter at the center of the deflection yoke 2 can not be effective as a method to solve the problem described above.

Accordingly, it is the object of the present invention to provide an in-line three beam type electron gun for color cathode ray tubes which is capable of equalizing shape of beam spots of the three electron beams at the right and left ends of a fluorescent screen.

SUMMARY OF THE INVENTION

To achieve the above-mentioned object, the in-line three beam type electron gun for color cathode ray tubes is featured in that the focus electrode is divided into at least two focus electrodes, three electron beam passage apertures are provided on each focus electrode, the electron beam passage aperture disposed on the one end side of at least one focus electrode has astigmatism different from the electron beam passage aperture disposed on the other end side, the electron beam passage apertures disposed on both end sides of said focus electrode have different astigmatism from electron beam passage apertures disposed on both end sides facing each other of the adjacent focus electrodes.

With reference to an specified electron beam passage aperture group through which a specified electron beam passes when other electron beam passage aperture groups through which other electron beams pass are considered, the different astigmatism means such shape of the electron beam passage aperture that differentiates between the quadrupole action exerted on the specified electron beam which passes the specified electron beam passage group and the quadrupole action exerted on the other electron beams which pass the other electron beam passage groups. As an example, the case in which an electron beam passage aperture disposed on the one end side of a specified focus electrode has vertically long astigmatism and an electron beam passage aperture disposed on the other end side has horizontally long astigmatism, and/or the case in which an electron beam passage aperture disposed on the one end side of a specified focus electrode has vertically long astigmatism or horizontally long astigmatism, and an electron beam passage aperture disposed on the other end side has a circular shape or square shape, the electron beam passage aperture disposed on the one end side of the focus electrode is regarded different in astigmatism from the electron beam passage aperture disposed on the other end side.

In the in-line three beam type electron gun for color cathode ray tubes of the present invention, it is often desirable to shield the electron beam passage apertures disposed at the center of the respective focus electrodes for consistent convergence on the fluorescent screen of the electron beams which pass through such electron beam passage apertures.

In the in-line three beam type electron gun for color cathode ray tubes of the present invention, the focus electrode may be divided into an arbitrary number of electrodes as long as the number is 2 or larger, however the number is most desirably 3. In detail, the focus electrode is divided into the first focus electrode, second focus electrode, and third focus electrode, the electron beam passage aperture disposed on the one end sides of each focus electrodes has different astigmatism from the electron beam passage aperture disposed on the other end side, and the electron beam passage apertures disposed on both end sides of each electrodes have different astigmatism from the electron beam passage apertures disposed on both end sides facing each other of the adjacent focus electrodes.

In such embodiment that the focus electrode is divided into three electrodes, a focus voltage is applied to the first and third focus electrodes, and a superimposed voltage of a voltage having saw tooth like waveform synchronous with horizontal deflection of the focus voltage and the focus voltage is applied to the second focus electrode, thereby the quadrupole action is exerted on electron beams which pass through electron beam passage apertures by means of the first, second, and third focus electrodes. In this case, it is desirable that the voltage having saw tooth like waveform exerts divergent action in the perpendicular direction in quadrupole action on the electron beam out of three electron beams which impinge on the fluorescent screen of a cathode ray tube impinging on the portion nearer to the end of the fluorescent screen in the horizontal direction, and exerts convergent action in the perpendicular direction in quadrupole action on the electron beam impinging on the portion farther from the end of the fluorescent screen in the horizontal direction. Further, it is desirable that, when the electron beam which passes through electron beam passage apertures disposed on the one end sides of the respective focus electrodes impinges on the portion nearer to the end side of the fluorescent screen of a cathode ray tube in the horizontal direction than the electron beam which passes through electron beam passage apertures disposed on the other end sides, a voltage applied to the second focus electrode is higher than the voltage applied to the first and third focus electrodes, and when the electron beam which passes through electron beam passage apertures disposed on the other end sides of the respective focus electrodes impinges on the portion nearer to the end side of the fluorescent screen of the cathode ray tube in the horizontal direction than the electron beam which passes electron beam passage apertures disposed on the one end sides of the respective focus electrodes, a voltage applied to the second focus electrode is lower than a voltage applied to the first and third focus electrode. In this embodiment, it is desirable that a shielding cylinder which extends from the electron beam passage aperture disposed at the center of the first focus electrode to the electron beam passage aperture disposed at the center of the third focus electrode is provided in order to shield electron beam passage apertures disposed at the center of the focus electrodes.

In the in-line three beam type electron gun for color cathode ray tubes of the present invention, the focus electrode is divided into two focus electrodes, an electron beam passage aperture disposed on the one end side of at least one focus electrode has different astigmatism from an electron beam passage aperture disposed on the other end side, electron beam passage apertures disposed on both sides of a focus electrode have different astigmatism from electron beam passage apertures disposed on both sides facing each other of the adjacent focus electrodes, thereby the direction of the main quadrupole effect exerted on the electron beam which passes the electron beam passage apertures disposed on the one end sides of the focus electrodes is reversed to the direction of the main quadrupole effect exerted on the electron beam which passes the electron beam passage apertures disposed on the other end sides of the focus electrodes. That is, if the quadrupole effect exerted on the electron beam which passes the electron passage apertures disposed on the one end sides of the focus electrodes is divergent action in the perpendicular direction, then the quadrupole effect exerted on the electron beam which passes the electron beam passage apertures disposed on the other end sides of the focus electrodes is convergent action in the perpendicular direction. As the result, the difference in the degree of convergent action and divergent action exerted on three electron beams in the magnetic field of the deflection yoke dependent on the position in the area of the deflection yoke where the electron beam passes can be offset. Thereby, the configuration of electron beam spots of three electron beams on the right and left periphery of the fluorescent screen is equalized.

DETAILED DESCRIPTION OF PREFERRED EMBODIMENTS

Figure 1A:
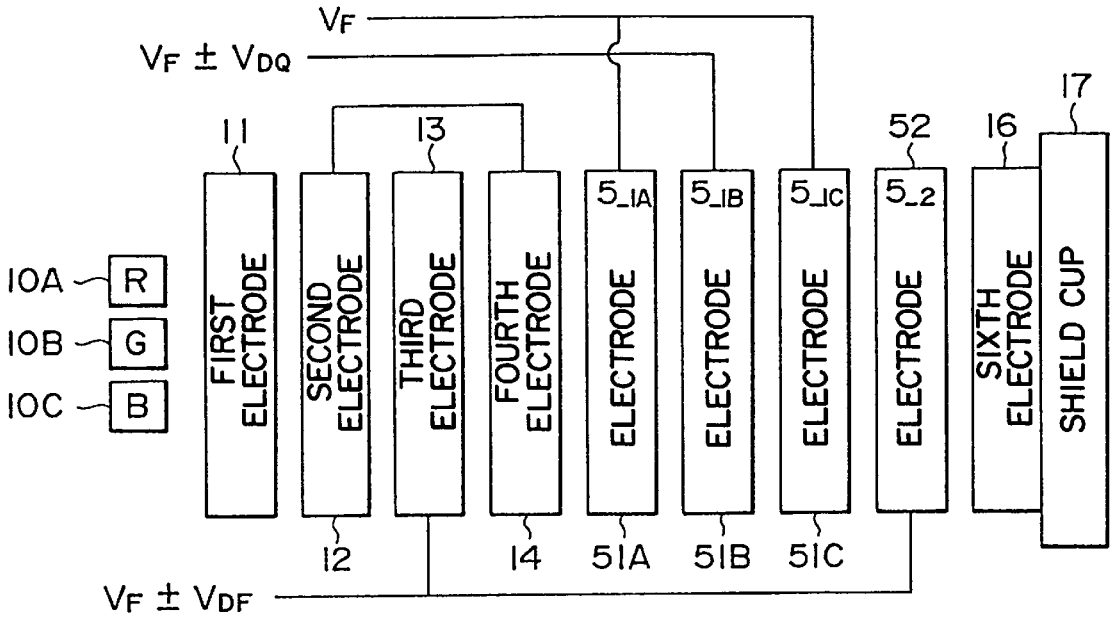
FIGS. 1A and 1B are a conceptual diagram of an electron gun for color cathode ray tubes in the first embodiment of the present invention, and a schematic diagram of respective focus electrodes for illustrating astigmatism of electron beam passage apertures disposed on both ends of the respective focus electrodes.

The present invention will be described in detail hereinafter with reference to embodiments of the present invention (abbreviated as embodiment hereinafter) referring to the drawings.

First Embodiment

FIG. 1A is a conceptual diagram of an in-line three beam type electron gun for color cathode ray tubes (refer simply to as electron gun hereinafter) of the first embodiment. The electron gun comprises three cathodes 10A, 10B, and 10C, first electrode 11, second electrode, third electrode 13, fourth electrode 14, fifth electrodes, sixth electrode 16, and sealed cap 17. The fifth electrodes comprises a $5_{-1}$ electrode and a $5_{-2}$ electrode. The $5_{-1}$ electrode which is equivalent to a focus electrode is divided to the first focus electrode of $5_{-1A}$ electrode 51A, second focus electrode of $5_{1B}$ electrode 51B, and third focus electrode of $5_{-1C}$ electrode 51C. Components other than the $5_{-1}$ electrode have the same structure as known, therefore detailed description is omitted.

Figure 1B:
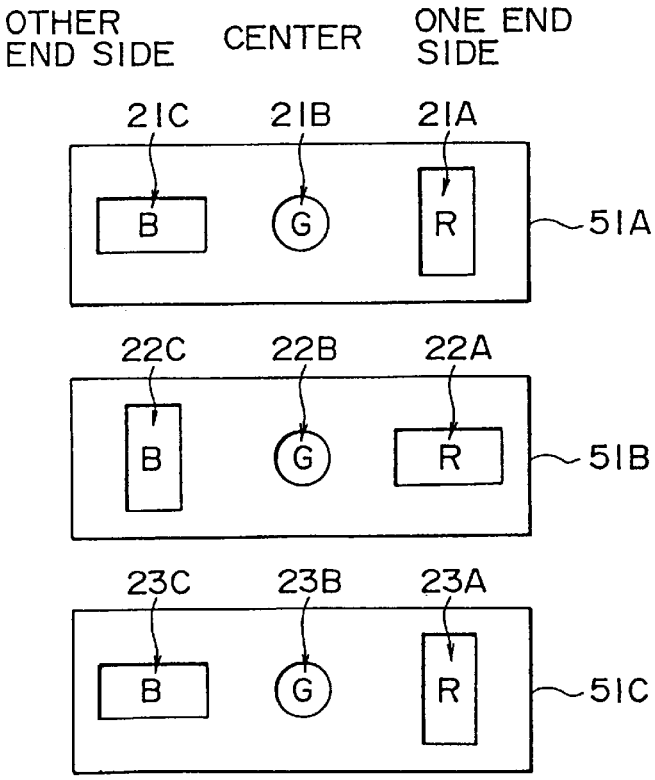
Figure 2A:
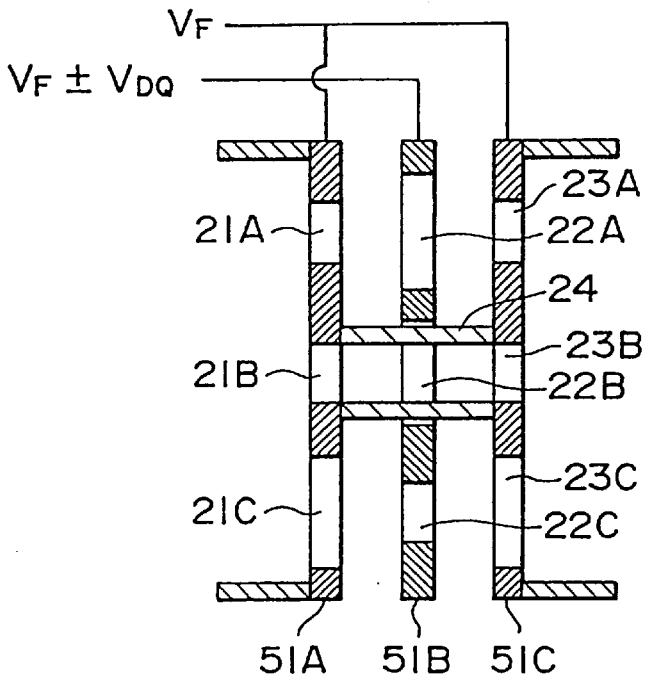
FIGS. 2A and 2B are a schematic cross-sectional view of a focus electrode assembly, and a schematic perspective view for illustrating disposition of electron beam passage apertures disposed on the respective focus electrodes.
Figure 2B:
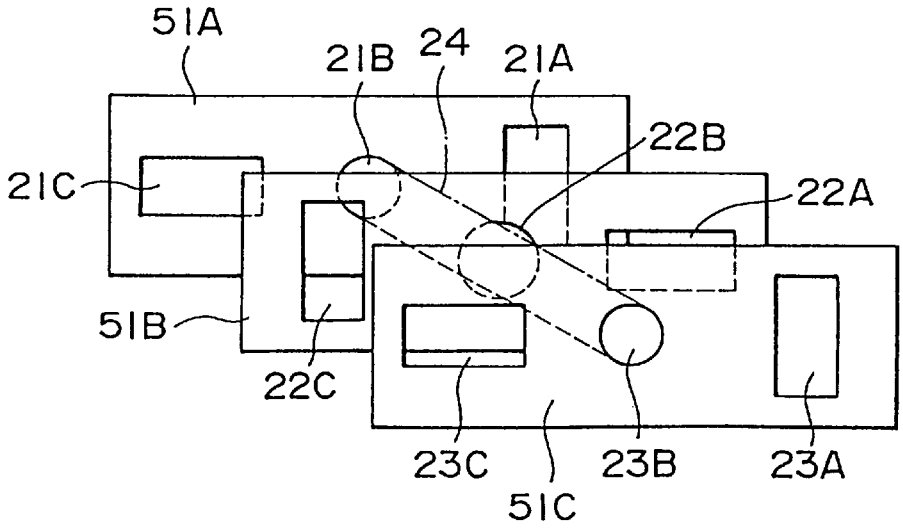

The respective focus electrodes ($5_{-1A}$ electrode 51A, $5_{-1B}$ electrode 51B, and $5_{-1C}$ electrode 51C) have three electron beam passage apertures. The schematic diagram of the electron beam passage apertures is shown in FIG. 1B. A schematic cross-sectional diagram along the horizontal plane of the $5_{-1}$ electrode assembly is shown in FIG. 2A. Further, FIG. 2B is a schematic perspective view for illustrating disposition of the three electron beam passage apertures of the focus electrode ($5_{-1A}$ electrode 51A, $5_{-1B}$ electrode 51B, and $5_{-1C}$ electrode 51C) of $5_{-1}$ electrode assembly.

Electron beam passage apertures 21A, 22A, and 23A (in the first embodiment, the electron beam R passes through) formed on the one end of the respective focus electrodes ($5_{-1A}$ electrode 51A, $5_{-1B}$ electrode 51B, and $5_{-1C}$ electrode 51C) are different in astigmatism from electron beam passage apertures 21C, 22C, and 23C (in the first embodiment, the electron beam B passes through) formed on the other end of the respective focus electrodes. In the first embodiment, such astigmatism involves a vertically long astigmatism or a horizontally long astigmatism. Further, the astigmatism of the electron beam passage apertures formed on both ends of a focus electrode is different from that of the electron beam passage apertures formed on both ends of the adjacent focus electrodes disposed facing each other. In detail, the astigmatism of the electron beam passage apertures 21A and 21C disposed on both ends of the first focus electrode ($5_{-1A}$ electrode 51A) are disposed inversely to the astigmatism of the electron beam passage apertures 22A and 22C disposed on both ends of the second focus electrode ($5_{-1B}$ electrode 51B) disposed facing to the first focus electrode ($5_{-1A}$ electrode 51A) , the astigmatism of the electron beam passage apertures 22A and 22C disposed on both ends of the second focus electrode ($5_{-1B}$ electrode 51B) are disposed inversely to the astigmatism of the electron beam passage apertures 23A and 23C disposed on both ends of the third focus electrode ($5_{-1C}$ electrode 51C) disposed facing to the second focus electrode ($5_{-1B}$ electrode 51B).

Further in detail, the electron beam passage apertures 21A and 23A (the electron beam R passes through them in the first embodiment) disposed on the one end sides of the first and third focus electrodes are formed in vertically rectangular shape the electron beam passage apertures 21B and 23B (the electron beam G passes through them in the first embodiment) disposed at the center of the first and third focus electrodes are formed in circular shape, and the electron beam passage apertures 21C and 23C (the electron beam B passes through them in the first embodiment) disposed on the other end sides of the first and third focus electrodes are formed in horizontally long rectangular shape. On the other hand, the electron beam passage aperture 22A (the electron beam R passes through it in the first embodiment) disposed on the one side of the second focus electrode ($5_{-1B}$ electrode 51B) is formed in horizontally long rectangular shape, the electron beam passage aperture 22B (the electron beam G passes through it) disposed at the center of the second focus electrode is formed in circular shape, and the electron beam passage aperture 22C disposed on the other end side of the second focus electrode is formed in vertically long rectangular shape.

The electron beam passage apertures 21B, 22B, and 23B disposed at the center of the respective focus electrodes ($5_{-1A}$ electrode 51A, $5_{-1B}$ electrode 51B, and $5_{-1C}$ electrode 51C) are shielded. In detail, as shown in FIGS. 2A and B, a hollow cylindrical shielding cylinder 24 which extends from the electron beam passage aperture 21B disposed at the center of the first focus electrode ($5_{-1A}$ electrode 51A) to the electron beam passage aperture 23C disposed at the center of the third focus electrode ($5_{-1C}$ electrode 51C) is provided. The shielding cylinder 24 is not in contact with the electron beam passage aperture 22B disposed at the center of the $5_{-1B}$ electrode 51B. The $5_{-1A}$ electrode 51A, $5_{-1B}$ electrode 51B, $5_{-1C}$ electrode 51C, and shielding cylinder 24 are made of, for example, stainless steel, and the 5-1 electrode assembly is fabricated by welding these components.

As shown in FIG. 1A, to the first and third focus electrode ($5_{-1A}$ electrode 51A and $5_{-1C}$ electrode 51C), a focus voltage $V_F$ is applied through the stem (not shown in the drawing). On the other hand, to the second focus electrode ($5_{-1B}$ electrode 51B), a voltage ($V_F+V_{DQ}$) that is a superimposed voltage of a dynamic quadrupole voltage $V_{DQ}$ having a saw-tooth waveform synchronous with horizontal deflection of the focus voltage $V_F$ applied to the first and third electrodes and the focus voltage $V_F$ is applied. Thereby, quadrupole action is exerted (acting) on the electron beam R and the electron beam B which pass through the electron beam passage apertures 21A, 22A, and 23A and 21C, 22C, and 23C respectively by means of the first, second, and third focus electrodes ($5_{-1A}$ electrode 51A, $5_{-1B}$ electrode 51B, and $5_{-1C}$ electrode 51C).

Figure 3A:
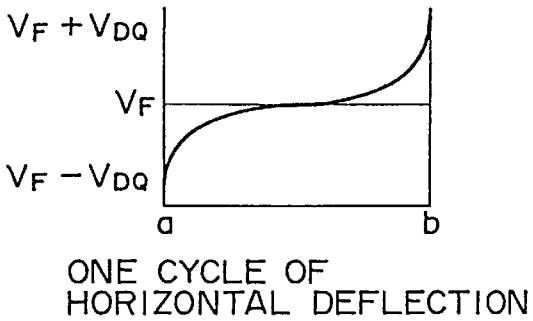
FIGS. 3A and 3B are schematic diagrams for illustrating voltage waveform having saw tooth like waveform in the present invention.

In the first embodiment, as the dynamic quadrupole voltage $V_{DQ}$ having a saw-tooth waveform, a pseudo parabola waveform as shown in FIG. 3A is used. In the first embodiment, in the case where three electron beams impinge on the fluorescent screen of a cathode ray tube, the dynamic quadrupole voltage $V_{DQ}$ having a saw tooth waveform is a voltage which exerts divergent action in the perpendicular direction in the quadrupole action on the electron beam impinging on the portion nearer to the end of the fluorescent screen in the horizontal direction, and exerts convergent action in the perpendicular direction in the quadrupole action on the electron beam impinging on the portion farther from the end of the fluorescent screen in the horizontal direction.

Figure 5:
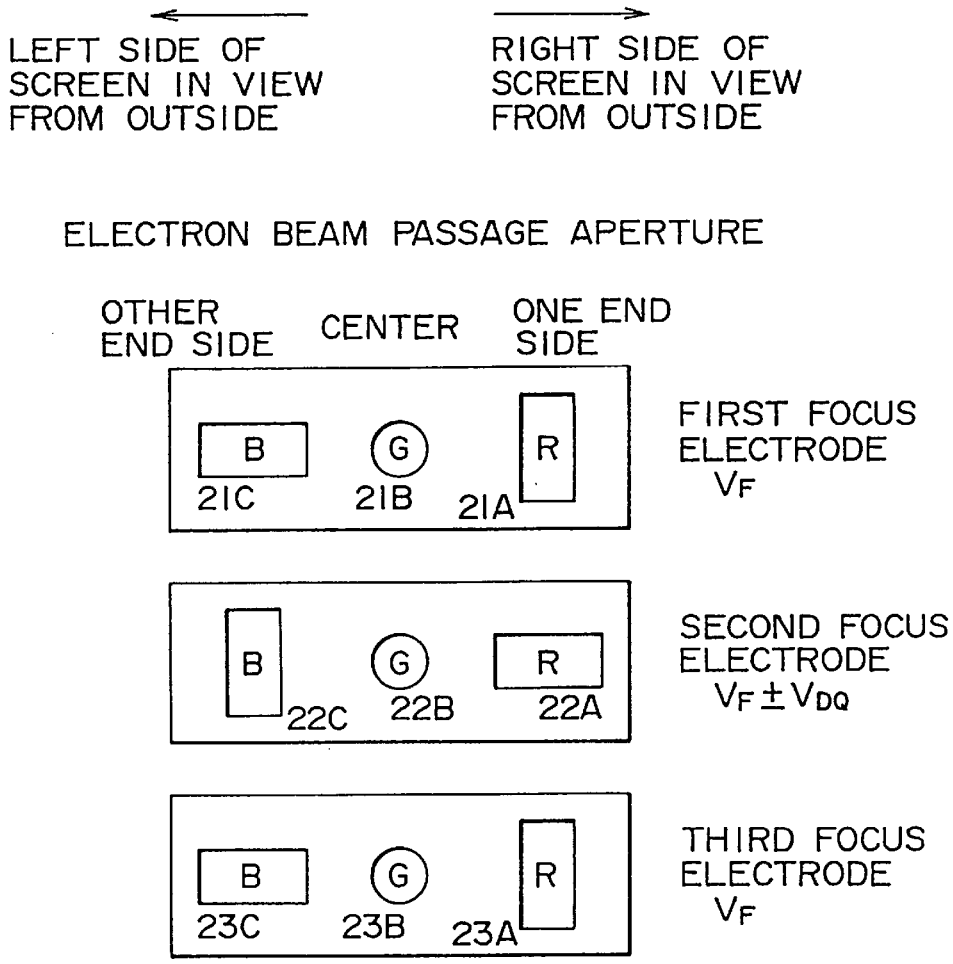
FIG. 5 is a diagram for illustrating operation of the electron gun for color cathode ray tubes in the first embodiment of the present invention.

That is as shown in FIG. 3A and FIG. 5, in the case where the electron beam passing through the electron beam passage apertures 21A, 22A, and 23A disposed on the one end side of the respective focus electrodes ($5_{-1A}$ electrode 51A, $5_{-1B}$ electrode 51B, and $5_{-1C}$ electrode 51C) impinges on the portion nearer to the end side in horizontal direction of the fluorescent screen of a cathode ray tube than the electron beam passing through the electron beam passage apertures 21C, 22C, and 23C disposed on the other end side of the respective focus electrodes, a voltage applied to the second focus electrode ($5_{-1B}$ electrode 51B) is higher than that applied to the first and third focus electrodes ($5_{-1A}$ electrode 51A and $5_{-1C}$ electrode 51C) (refer to the state [b] in the FIG. 3A). In detail, because a voltage $V_F+V_{DQ}$ is applied to the second focus electrode ($5_{-1B}$ electrode 51B) when the three electron beams impinge on the right end side of the fluorescent screen (state [b]), the divergent action in the perpendicular direction in the quadrupole action is exerted on the electron beam R impinging on the portion nearer to the end of the fluorescent screen in the horizontal direction. In other words, the electron beam R has a vertically long cross-section just after the electron beam R passes through the $5_{-1}$ electrodes. On the other hand, the convergent action in the perpendicular direction in the quadrupole action is exerted on the electron beam B impinging on the portion farther from the end of the fluorescent screen in the horizontal direction. In other words, the electron beam B has a horizontally long cross-section just after the electron beam B passes through the $5_{-1}$ electrodes.

Figure 6:
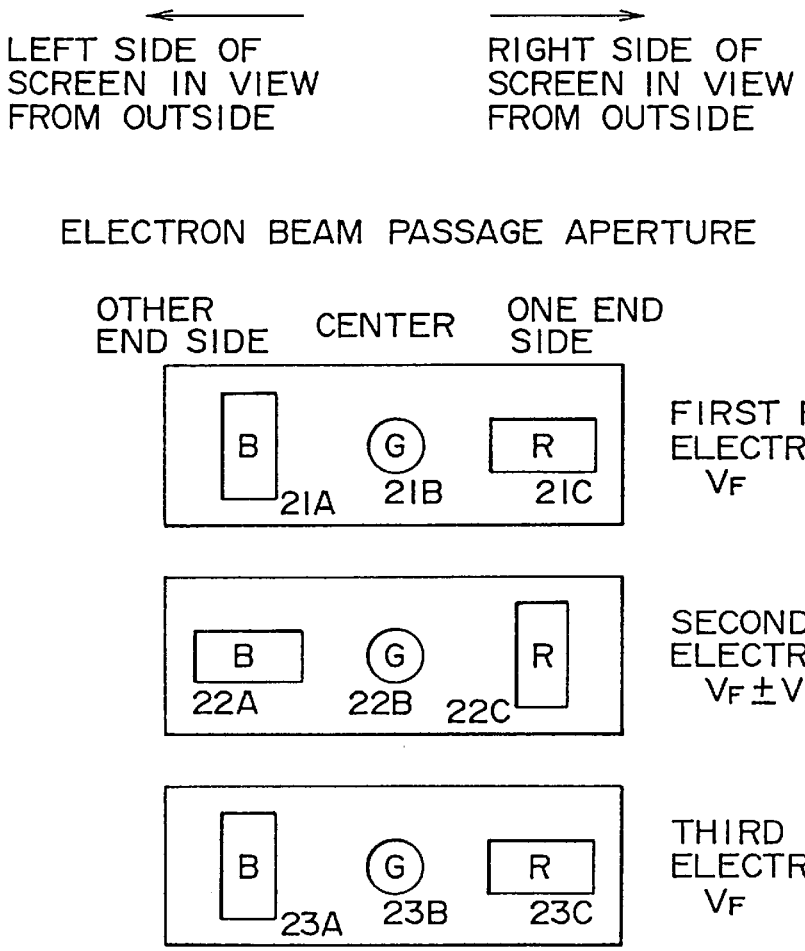
FIG. 6 is a diagram for illustrating operation of the electron gun for color cathode ray tubes in the second embodiment of the present invention.

The phrase divergent action in the vertical direction means the action that divergent action (concave lens effect) acts on an electron beam in the vertical direction and convergent action (convex lens effect) act on an electron beam in the horizontal direction. In FIG. 5 and FIG. 6, the phrases "the left hand side of the screen" and the right hand side of the screen mean the right side and left side respectively when the fluorescent screen of a color cathode ray tube is viewed from the outside. Further in FIG. 5 and FIG. 6, in the case that the quadrupole action exerted on an electron beam by means of focus electrodes is divergent action in the vertical direction, that is, the electron beam receives the action so as to be vertically long, the action is represented as "vertical direction" action. On the other hand, in the case that quadrupole action exerted on an electron beam by means of focus electrodes is mainly convergent action (convex lens effect) in the vertical direction, that is, the electron beam receives the action so as to be horizontally long, the action is represented as "horizontal direction" action.

On the other hand, in the case where the electron beam (electron beam B) passing through the electron beam passage apertures 21C, 22C, and 23C disposed on the other end side of the respective focus electrodes ($5_{-1A}$ electrode 51A, $5_{-1B}$ electrode 51B, and $5_{-1C}$ electrode 51C) impinges on the portion nearer to the end side in horizontal direction of the fluorescent screen of a cathode ray tube than the electron beam (electron beam R) passing through the electron beam passage apertures 21A, 22A, and 23A disposed on the one end side of the respective focus electrodes, a voltage applied to the second focus electrode ($5_{1B}$ electrode 51B) is lower than that applied to the first and third focus electrodes ($5_{-1A}$ electrode 51A and $5_{-1C}$ electrode 51C) (refer to the state [a] in the FIG. 3A). In detail, on the other hand, because a voltage $V_f$-$V_{DQ}$ is applied to the second focus electrode ($5_{-1B}$ electrode 51B) when the three electron beams impinge on the right end side of the fluorescent screen (state [a]), the divergent action in the perpendicular direction in the quadrupole action is exerted on the electron beam B impinging on the portion nearer to the end of the fluorescent screen in the horizontal direction. On the other hand, the convergent action in the perpendicular direction in the quadrupole action is exerted on the electron beam R impinging on the portion farther from the end of the fluorescent screen in the horizontal direction.

Because the electron beam passage apertures 21B, 22B, and 23B disposed at the center of the respective focus electrodes ($5_{-1A}$ electrode 51A, $5_{-1B}$ electrode 51B, and $5_{-1C}$ electrode 51C) are shielded by means of the shielding cylinder 24, quadrupole effect is not exerted on the electron beam G which passes through the electron beam passage apertures 21B, 22B, and 23B, but only the effect of the focus voltage $V_F$ is exerted on the electron beam G, thereby the electron beam G focuses consistently on the fluorescent screen.

Figure 8:
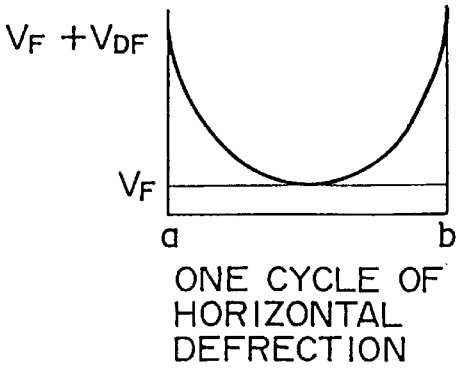
FIG. 8 is a schematic diagram for illustrating a dynamic focus voltage synchronous with horizontal deflection of the focus voltage.

To the third electrode 13 and $5_{-2}$ electrode 52, a voltage that is a superimposed voltage ($V_F+V_{DF}$) of a dynamic focus voltage $V_{DF}$ (refer to FIG. 8) synchronous with horizontal deflection of the focus voltage $V_F$ applied to the $5_{-1C}$ electrode 51C and the focus voltage $V_F$ is applied as in the related art. Thereby a quadrupole lens is formed between the $5_{-1C}$ electrode 51C and $5_{-2}$ electrode 52, and the strength of the focus lens formed between the $5_{-2}$ electrode 52 and the sixth electrode 16 is varied. As the result, the shape of electron beams on the right and left periphery of the fluorescent screen is improved.

Figure 10A:
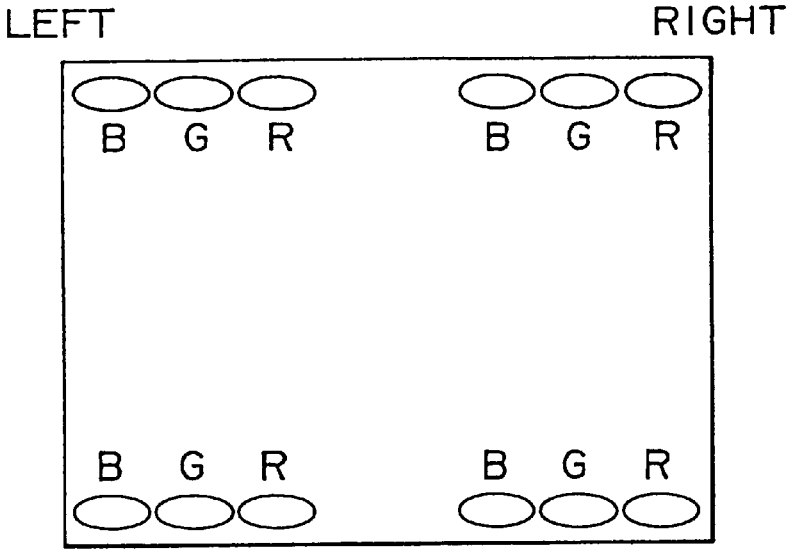
FIGS. 10A and 10B are schematic diagrams for illustrating the shape of electron beam spots on the fluorescent screen of the electron gun for color cathode ray tubes of the present invention.

The quadrupole effect exerted on the electron beams by means of the respective focus electrodes (the $5_{-1A}$ electrode 51A, $5_{-1B}$ electrode 51B, and $5_{-1C}$ electrode 51C) offsets the difference in degree of convergent action and divergent action exerted on three electron beams in the magnetic field of the deflection yoke 2 which depends on the position in the magnetic field through which the three electron beams pass. In detail, for example, when the three electron beams impinge on the right side end of the fluorescent screen of a cathode ray tube, the electron beam R distorted by means of the quadrupole lens formed between the $5_{-1C}$ electrode 51C and the $5_{-2}$ electrode 52 receives more intense convergent action in the perpendicular direction in the magnetic field of the deflection yoke 2 than the electron beam B. However, the cross-sectional shape of the electron beam R is distorted already vertically long by means of the $5_{-1}$ electrode. On the other hand, the electron beam B receives less intense convergent action in the perpendicular direction in the magnetic field of the deflection yoke 2 than the electron beam R. However, the shape of the electron beam B is distorted already horizontally long by means of the $5_{-1}$ electrode. Therefore, the difference in degree of convergent action and divergent action exerted on the electron beams R and B in the magnetic field of the deflection yoke 2 can be offset. As the result, the configuration of beam spots of the three electron beams on the right and left periphery of the fluorescent screen is equalized (refer to FIG. 10A). The unclear red characters on the right side of the fluorescent screen and the unclear blue characters on the left side can be consistently avoided.

Second embodiment

In the second embodiment, electron beam passage apertures provided on the respective focus electrodes are disposed inversely to the electron beam passage apertures in the first embodiment. In detail, as shown in FIG. 6, the electron beam passage apertures 21A and 23A (the electron beam B passes through them in the second embodiment) disposed on the one end side of the first and third focus electrodes ($5_{-1A}$ electrode 51A and $5_{-1C}$ electrode 51C) are formed in vertically long astigmatism, the electron beam passage apertures 21B and 23B (the electron beam G passes through them) are formed in circular shape, and the electron beam passage apertures 21C and 23C (the electron beam R passes through them in the second embodiment) disposed on the other end side are formed horizontally long astigmatism. On the other hand, the electron beam passage aperture 22A (the electron beam B passes through it in the second embodiment) disposed on the one end side of the second focus electrode ($5_{-1B}$ electrode 51B) is formed in horizontally long astigmatism, the electron beam passage aperture 22B (the electron beam G passes through it) disposed at the center is formed in circular shape, and the electron beam passage aperture 22C (the electron beam R passes through it in the second embodiment) disposed on the other end side is formed in vertically long astigmatism. Also in the second embodiment, vertically long rectangular shape is used as the vertically long astigmatism, and horizontally long rectangular shape is used as the horizontally long astigmatism.

Figure 3B:
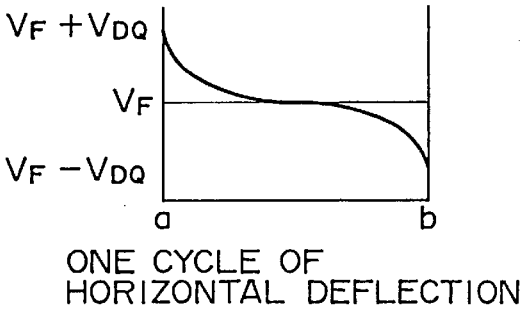

In the second embodiment, a pseudo parabola waveform shown in FIG. 3B is used as the waveform of the dynamic quadrupole voltage $V_{DQ}$ having saw tooth like waveform. Such dynamic quadrupole voltage $V_{DQ}$ is applied to the second focus electrode ($5_{-1B}$ electrode 51B). In detail as shown in FIG. 6, when the electron beam which passes through the electron beam passage apertures 21A, 22A, and 23A disposed on the one end side of the respective focus electrodes ($5_{-1A}$ electrode 51A, $5_{-1B}$ electrode 51B and $5_{-1C}$ electrode 51C) impinges on the portion of the fluorescent screen of a cathode ray tube located nearer to the end side in the horizontal direction than the electron beam which passes through the electron beam passage apertures 21C, 22C, and 23C disposed on the other end side of the respective focus electrodes, the voltage applied to the second focus electrode ($5_{-1B}$ electrode 51B) is higher than that applied to the first and third focus electrodes ($5_{-1A}$ electrode 51A and $5_{-1C}$ electrode 51C) (refer to the state [a] shown in FIG. 3). In detail, when the three electron beams impinge on the left side of the fluorescent screen, because a voltage $V_F+V_{DQ}$ is applied to the second focus electrode ($5_{-1B}$ electrode 51B) (refer to the state [a]), divergent action in the perpendicular direction in quadrupole action is exerted on the electron beam B impinging on the portion nearer to the end of the fluorescent screen in the horizontal direction. On the other hand, convergent action in the perpendicular direction in quadrupole action is exerted on the electron beam R impinging on the portion farther from the end of the fluorescent screen in the horizontal direction.

When the electron beam which passes through the electron beam passage apertures 21C, 22C, and 23C disposed on the other end side of the respective focus electrodes ($5_{-1A}$ electrode 51A, $5_{-1B}$ electrode 51B, and $5_{-1C}$ electrode 51C) impinges on the portion of the fluorescent screen of a cathode ray tube in the horizontal direction nearer to the end side than the electron beam which passes through the electron beam passage apertures 21A, 22A, and 23A disposed on the one end side of the respective focus electrodes, a voltage applied to the second focus electrode ($5_{-1B}$ electrode 51B) is lower than that applied to the first and third focus electrodes ($5_{-1A}$ electrode and $5_{-1C}$ electrode 51C) (refer to the state [b] in FIG. 3). In detail, on the other hand, when the three electron beams impinges on the right end side of the fluorescent screen, because a voltage $V_F$-$V_{DQ}$ is applied to the second focus electrode ($5_{-1B}$ electrode 51B) (the state [b]), divergent action in the perpendicular direction in quadrupole action is exerted on the electron beam R impinging on the portion nearer to the end of the fluorescent screen in the horizontal direction. On the other hand, convergent action in the perpendicular direction in quadrupole action is exerted on the electron beam B impinging on the portion farther from the end of the fluorescent screen in the horizontal direction. Thereby, the same effect as the first embodiment is obtained.

Third embodiment

In the electron gun the conceptual diagram of which is shown in FIG. 1A, the quadrupole lens is formed between the $5_{-1C}$ electrode 51C and $5_{-2}$ electrode 52, and the strength of the focus lens formed between the $5_{-2}$ electrode 52 and sixth electrode 16 is varied, thereby the shape of the electron beams on the right and left periphery of the fluorescent screen is improved.

Figure 10B:
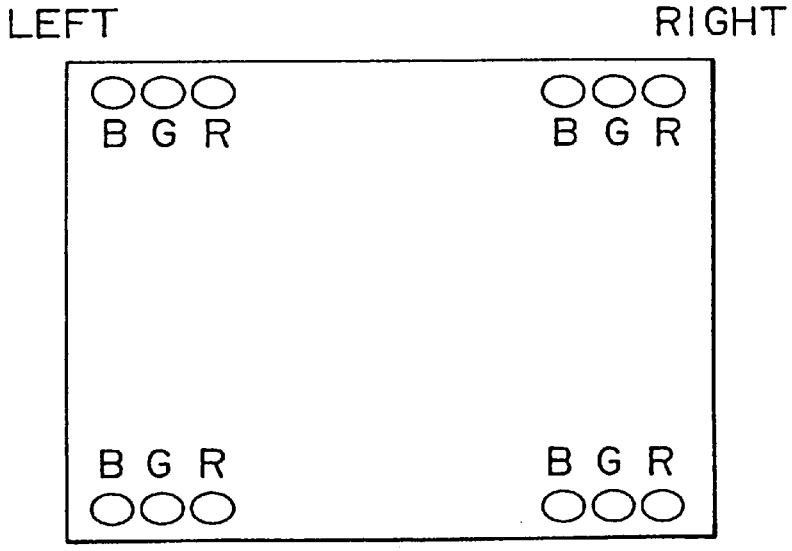

On the other hand, in the electron gun of the third embodiment the conceptual diagram of which is shown in FIG. 3, the fifth electrode is divided into three electrodes ($5_{-1}$ electrode 51, $5_{-2}$ electrode 52, and $5_{-3}$ electrode 53), and the $5_{-2}$ electrode which is equivalent to a focus electrode is divided into three electrodes, namely, the first focus electrode ($5_{-2A}$ electrode), second focus electrode ($5_{-2B}$ electrode), and third focus electrode ($5_{-2C}$). A superimposed voltage of a dynamic focus voltage $V_{DQ}$ (refer to FIG. 8) synchronous with horizontal deflection of a focus voltage $V_F$ applied to the $5_{-2A}$ electrode 52A and $5_{-2C}$ electrode 52C and the focus voltage $V_F$ is applied to the third electrode 13, $5_{-1}$ electrode 51, and $5_{-3}$ electrode 53 as in the prior art. Thereby, quadrupole lenses which act inversely each other are formed between the $5_{-1}$ electrode 51 and $5_{-2A}$ electrode 52A and between the $5_{-2C}$ electrode 52C and $5_{-3}$ electrode 53. Further, the strength of the focus lens formed between the 53 electrode 53 and sixth electrode 16 is varied. As the result, the spot shape of electron beams on the right and left periphery of the fluorescent screen is more improved (refer to FIG. 10B). Therefore, red characters on the right side of the fluorescent screen 4 and blue characters on the left side can be made clear.

Figure 4:
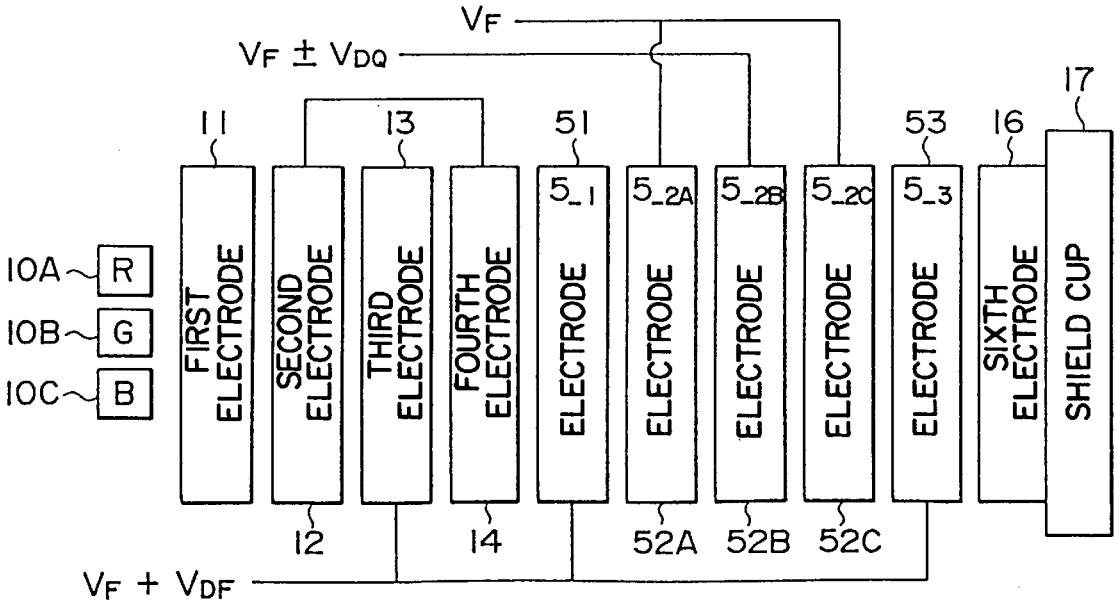
FIG. 4 is a conceptual diagram of an electron gun for color cathode ray tubes in the third embodiment of the present invention.

The structure and operation of the electron gun other than those described herein above as shown in FIG. 4 can be the same as the structure and operation of the electron guns described in the first embodiment and second embodiment. Therefore the detailed description is omitted herein.

The present invention has been described with reference to the embodiments of the present invention, the present invention is by no means limited to these embodiments. In the embodiments, the $5_{-1}$ electrode or $5_{-2}$ electrode is divided three electrodes, but the focus electrode to be divided into three electrodes is not limited to these electrodes. For example, in the electron gun structure shown in FIG. 1A, at least any one focus electrode out of the third electrode 13, the $5_{-1}$ electrode, and the $5_{-2}$ electrode may be divided, alternately in the electron gun structure shown in FIG. 4, at least any one of focus electrodes of the third electrode 13, the $5_{-1}$ electrode, $5_{-2}$ electrode, and $5_{-3}$ electrode may be divided into three electrodes.

Figure 7A:
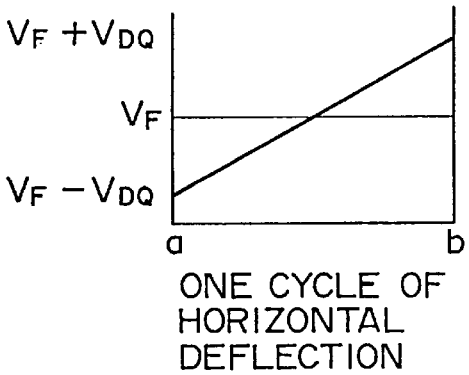
FIGS. 7A to 7D are schematic diagrams for illustrating different voltage waveforms having saw tooth like waveform in the present invention.
Figure 7B:
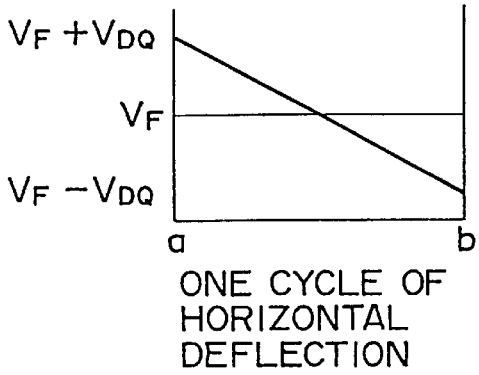
Figure 7C:
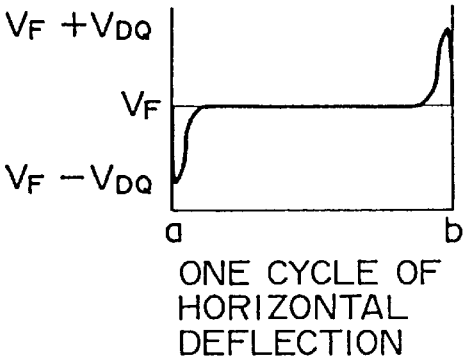
Figure 7D:
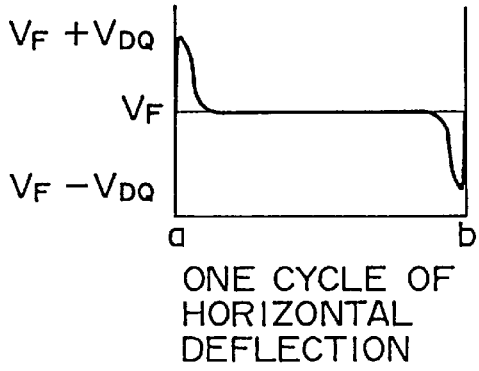

In the embodiments, the pseudo parabola waveform shown in FIGS. 3A and 3B is used as the waveform of dynamic quadrupole voltage $V_{DQ}$ having a saw tooth like waveform, but the waveform of the dynamic quadrupole voltage $V_{DF}$ having a saw tooth like waveform is not limited to this waveform, any one of waveforms exemplified in FIGS. 7A, 7B, 7C, and 7D may be used. Any waveform voltage may be used as long as the voltage gives divergent action in the perpendicular direction in quadrupole action exerted on one electron beam out of three electron beams which impinge on the portion on the fluorescent screen of a cathode ray tube nearer to the end of the fluorescent screen in the horizontal direction, and the voltage gives convergent action in the perpendicular direction in quadrupole action exerted on the electron beam impinging on the portion farther from the end of the fluorescent screen in the horizontal direction. In particular, because the shape of electron beam spot degrades significantly at the right and left side ends of the fluorescent screen, the waveforms shown in FIGS. 7C and 7D are sufficiently effective.

Figure 9A:
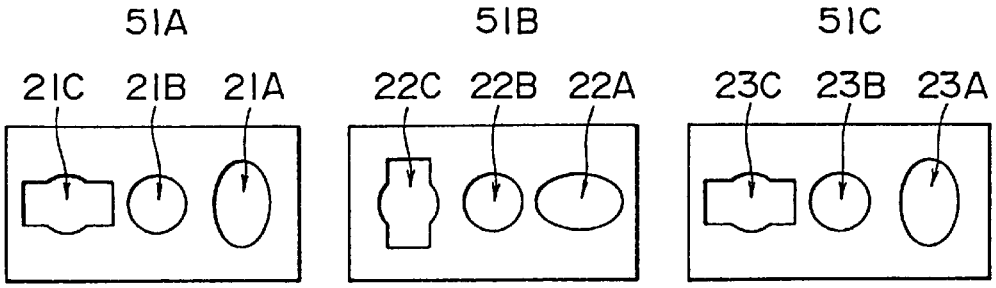
FIGS. 9A to 9C are schematic diagrams of respective focus electrodes for illustrating astigmatism of electron beam passage apertures disposed on both sides of the respective focus electrodes.

The astigmatism of the electron beam passage aperture provided on both ends of the respective focus electrodes is not limited to the combination of vertically long rectangular shape/horizontally long rectangular shape. For example, an arbitrary combination of vertically long astigmatism/horizontally long astigmatism such as vertically long rectangular shape/square shape, vertically long rectangular shape/circular shape, square shape/horizontally long rectangular shape, circular shape/horizontally rectangular shape, elliptical shape with the major axis coincident with the perpendicular direction/elliptical shape with the minor axis coincident with the perpendicular direction (refer to the electron beam passage apertures 21A, 22A, and 23A shown in FIG. 9A), elliptic shape with the major axis coincident with the perpendicular direction/circular shape, circular shape/elliptic shape with the minor axis coincident with the perpendicular direction, and combined shape of vertically long rectangular shape and circular shape/combined shape of horizontally rectangular shape and circular shape (the electron beam passage apertures 21C, 22C, and 23C in FIG. 9A may be used.

Figure 9B:
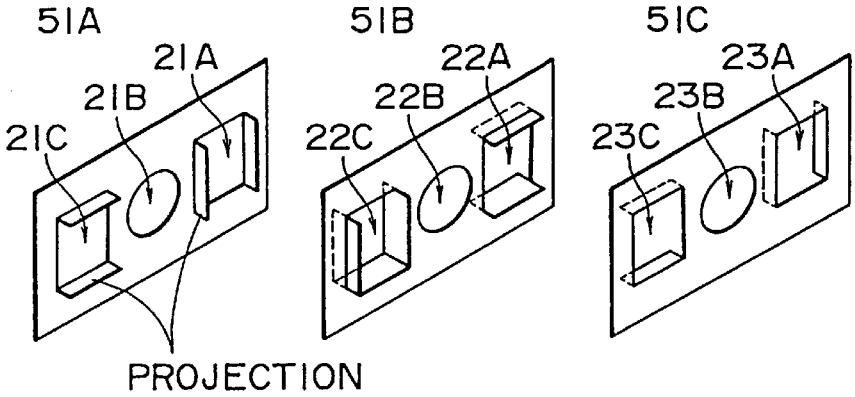

Alternately as shown in FIG. 9B, such structure, as projections are provided on the right and left periphery of the electron beam passage apertures 21A and 23A disposed on the one end side of the first and third focus electrodes (the $5_{31\ 1A}$ electrode 51A and $5_{-1C}$ electrode 51C), the electron beam passage apertures 21B and 23B disposed at the center are circular, and projections are provided on the top and bottom periphery of the electron beam passage apertures disposed on the other end side, and projections are provided on the top and bottom periphery of the electron beam passage aperture 22A disposed on the one end side of the second focus electrode (the $5_{-1B}$ electrode 51B), the electron beam passage aperture 22B disposed at the center is circular, and projections are provided on the right and left periphery of the electron beam passage aperture 22C disposed on the other end side, may be used. In this case, for example, a shielding cylinder which extends from the electron beam passage aperture 21B disposed at the center of the first focus electrode (the $5_{-1A}$ electrode 51A) to the electron beam passage aperture 23B disposed at the center of the third focus electrode (the $5_{-1C}$) electrode is provided.

Figure 9C:
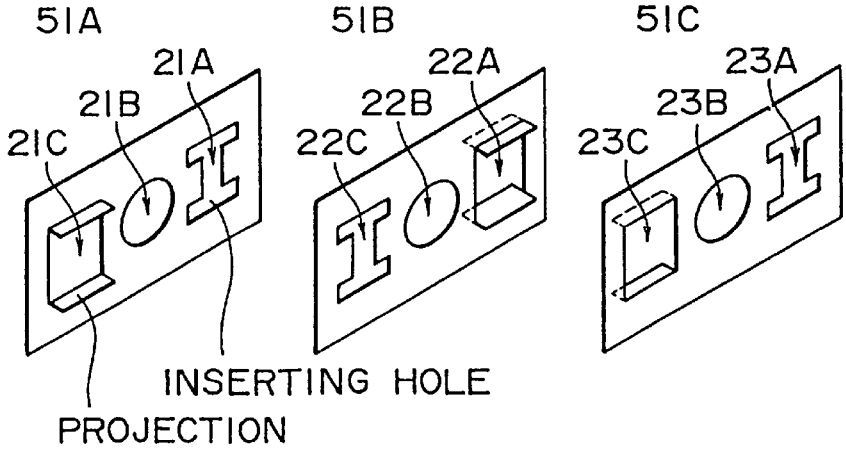

Further as shown in FIG. 9C, such structure, as insertion holes are provided on the top and bottom periphery of the electron beam passage apertures 21A and 23A disposed on the one end side of the first and third focus electrodes (the $5_{-1A}$ electrode 51A and $5_{-1C}$ electrode 51C), the electron beam passage aperture disposed at the center is circular, and projections are provided on the top and bottom periphery of the electron beam passage apertures 21C and 23C disposed on the other end side, projections to be inserted into the insertion holes provided on the one side of the first and third focus electrodes are provided on the top and bottom periphery of the electron beam passage aperture 22A disposed on the one side of the second focus electrode (the $5_{-1B}$ electrode 51B), the electron beam passage aperture 22B disposed at the center is circular, insertion holes into which the projections disposed on the other end side of the first and third focus electrodes are to be inserted are provided on the top and bottom periphery of the electron beam passage aperture 22C disposed on the other end side, may be used. In this case, for example, a shielding cylinder which extends from the electron beam passage aperture 21B disposed at the center of the first focus electrode (the $5_{-1A}$ electrode 51A) to the electron beam passage aperture 23B disposed at the center of the third focus electrode (the $5_{-1C}$ electrode 51C) is provided.

Figure 11:
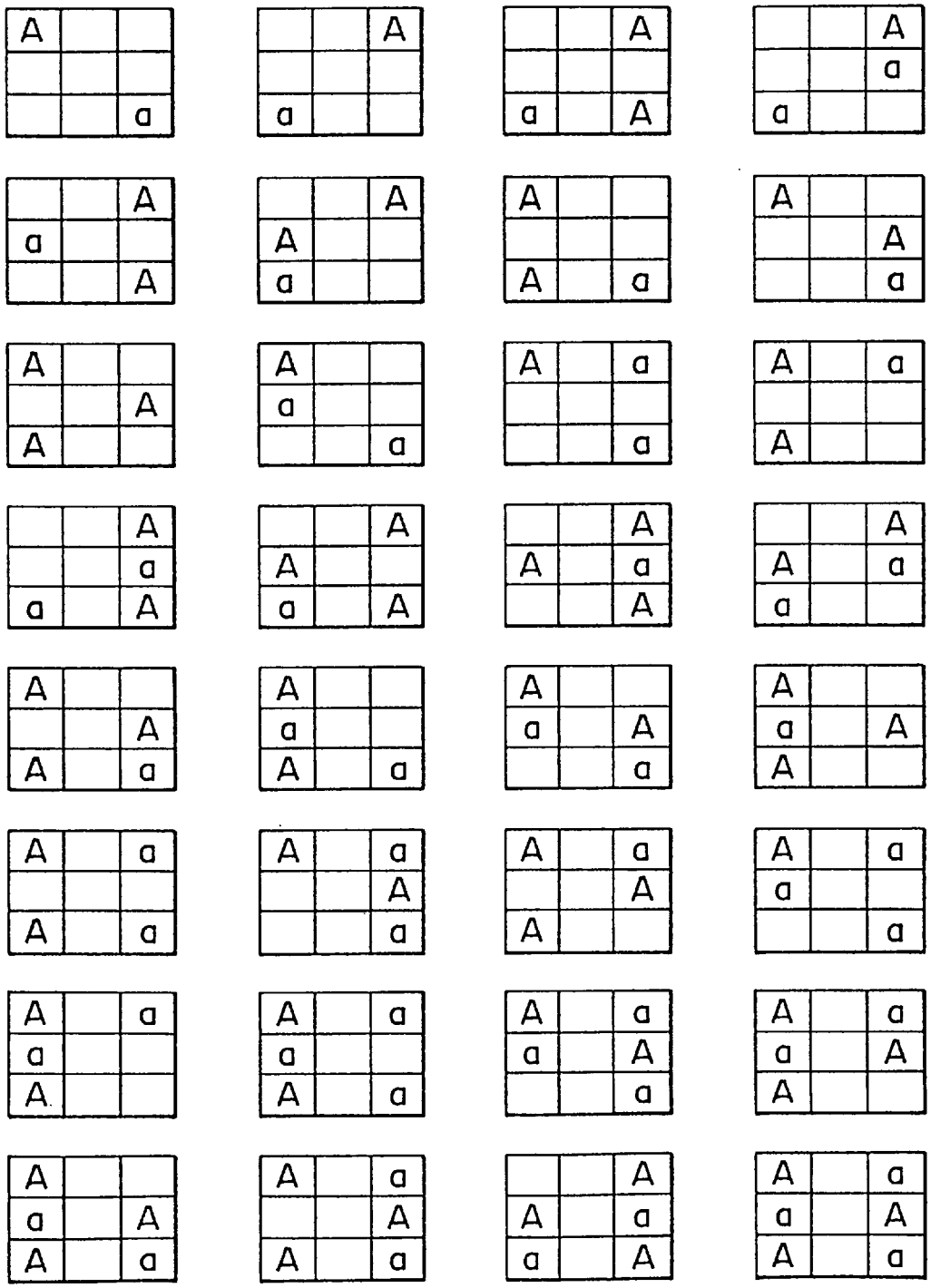
FIG. 11 is a set of diagrams for illustrating various modification of the existence of astigmatism of electron beam passage apertures of respective focus electrodes for the case that the focus electrode is divided into three electrodes in an electron gun for color cathode ray tubes of the present invention.

In the case where a focus electrode is divided into three electrodes, various modification of the existence of astigmatism of the electron beam passage aperture provided on the respective focus electrodes are shown in FIG. 11. In FIG. 11, the focus electrodes are represented with 3×3 matrix. In this matrix, the first row represents the first focus electrode, the second row represents the second electrode, and the third row represents the third electrode. The first column represents the electron beam passage apertures where the electron beam B passes, the second column represents the electron beam passage apertures where the electron beam G passes, and the third column represents the electron beam passage apertures where the electron beam R passes. The blank sections in a matrix represent that the electron beam passage apertures corresponding to the blank sections are not astigmatism apertures, that is, these apertures are, for example, circular or square. Characters [A] and [a] represent that the electron beam passage aperture are astigmatism apertures.

The difference between characters [A] and [a] means that the astigmatism of the electron beam passage aperture is different. Which of $V_F$ and $V_{DQ}$ is to be applied to which focus electrode may be determined based on the astigmatism and disposition of the electron beam passage apertures with reference to the first embodiment and second embodiment. Further, which electron beam passage aperture of which focus electrode is to be astigmatic may be determined based on the condition to be satisfied that the astigmatism of the electron beam passage aperture disposed on the one end side of a focus electrode is different from that of the electron beam passage aperture disposed on the other end side, and the astigmatism of the electron beam passage apertures disposed on both ends of this focus electrode are different from astigmatism of the electron beam passage apertures disposed on both sides of the adjacent focus electrodes facing to this focus electrode.

Figure 12:
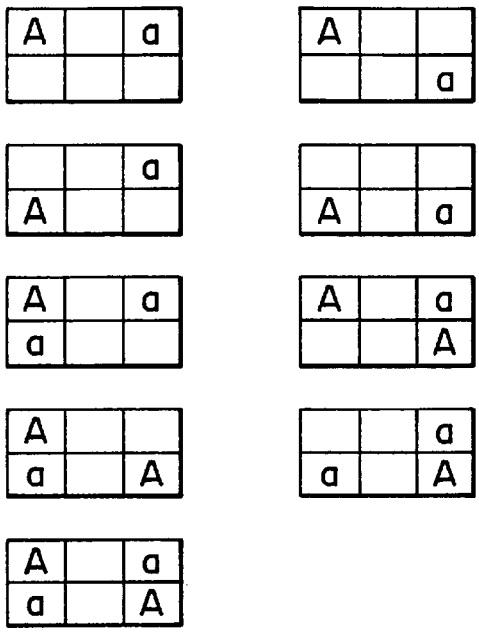
FIG. 12 is a set of diagrams for illustrating various modification of the existence of astigmatism of electron beam passage apertures of respective focus electrodes for the case that the focus electrode is divided into two electrode in an electron gun for color cathode ray tubes of the present invention.
Figure 13A:
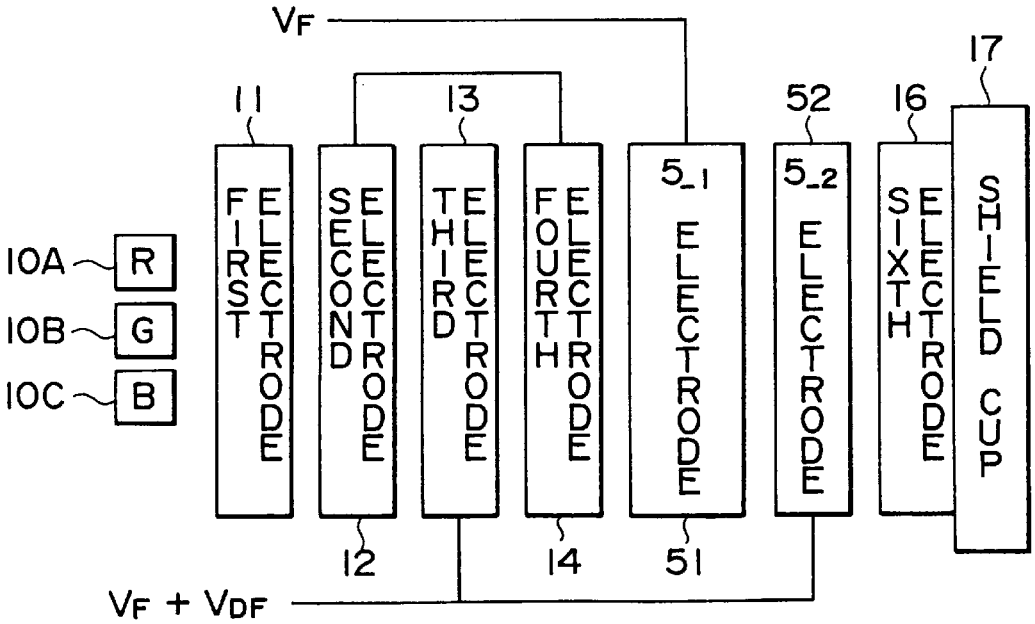
FIGS. 13A to 13D are conceptual diagrams of an electron gun for color cathode ray tubes having a conventional built-in quadrupole lens, and schematic diagrams for illustrating the shape of electron beam passage apertures provided on electrodes for forming the quadrupole lens.
Figure 13B:
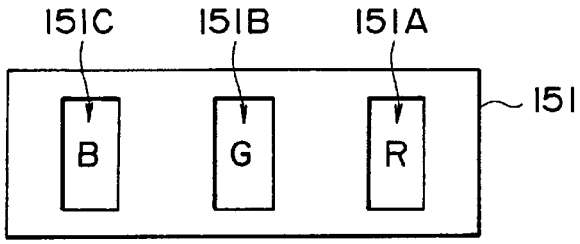
Figure 13C:
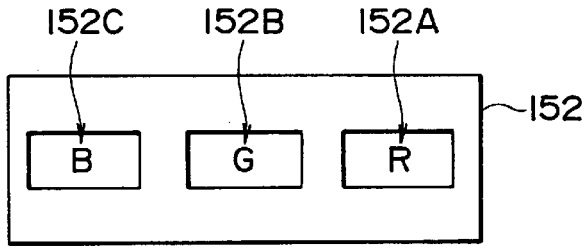
Figure 13D:
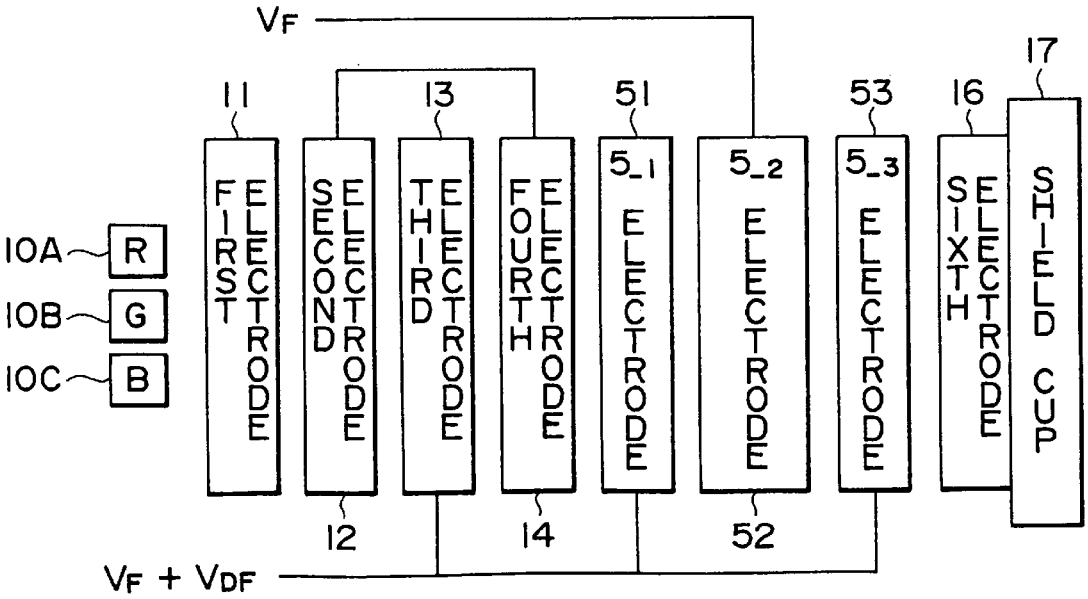
Figure 14:
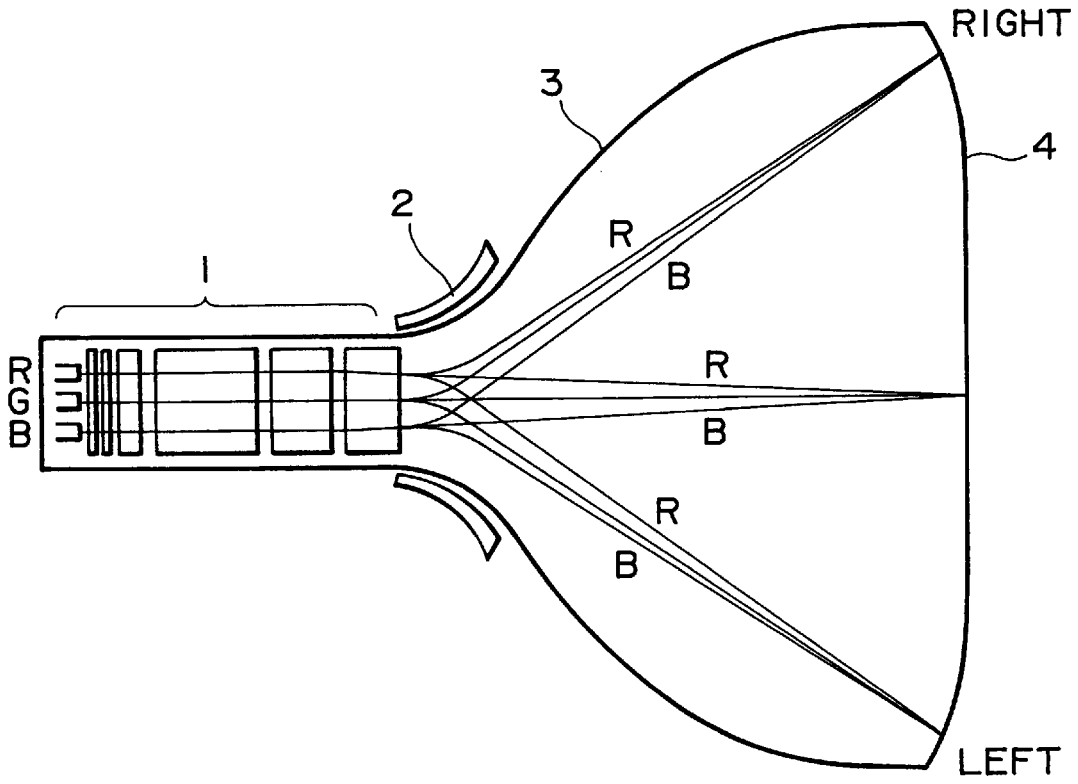
FIG. 14 is a schematic diagram of a color cathode ray tube.
Figure 15A:
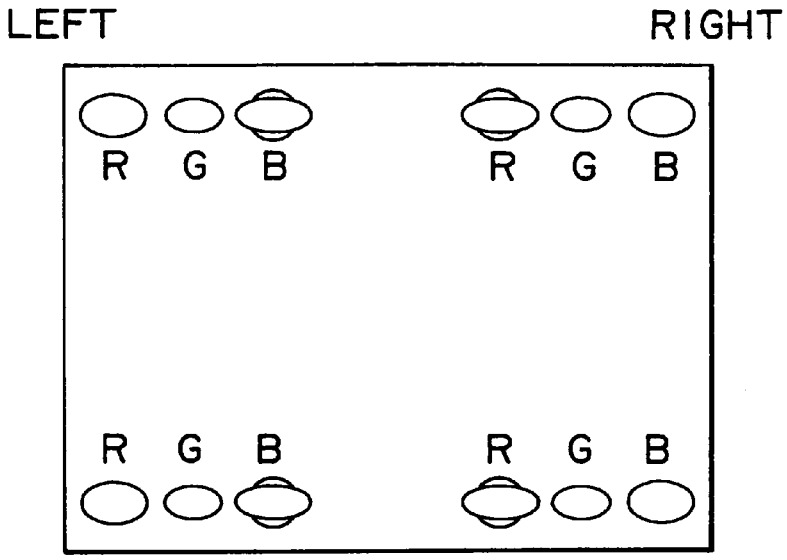
FIGS. 15A and 15B are schematic diagrams for illustrating the shape of electron beam spots on the fluorescent screen in the prior art.
Figure 15B:
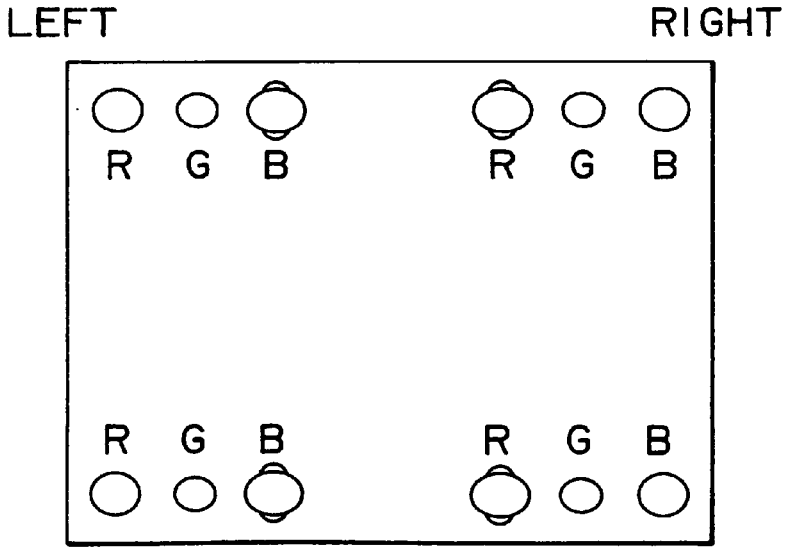
Figure 16:
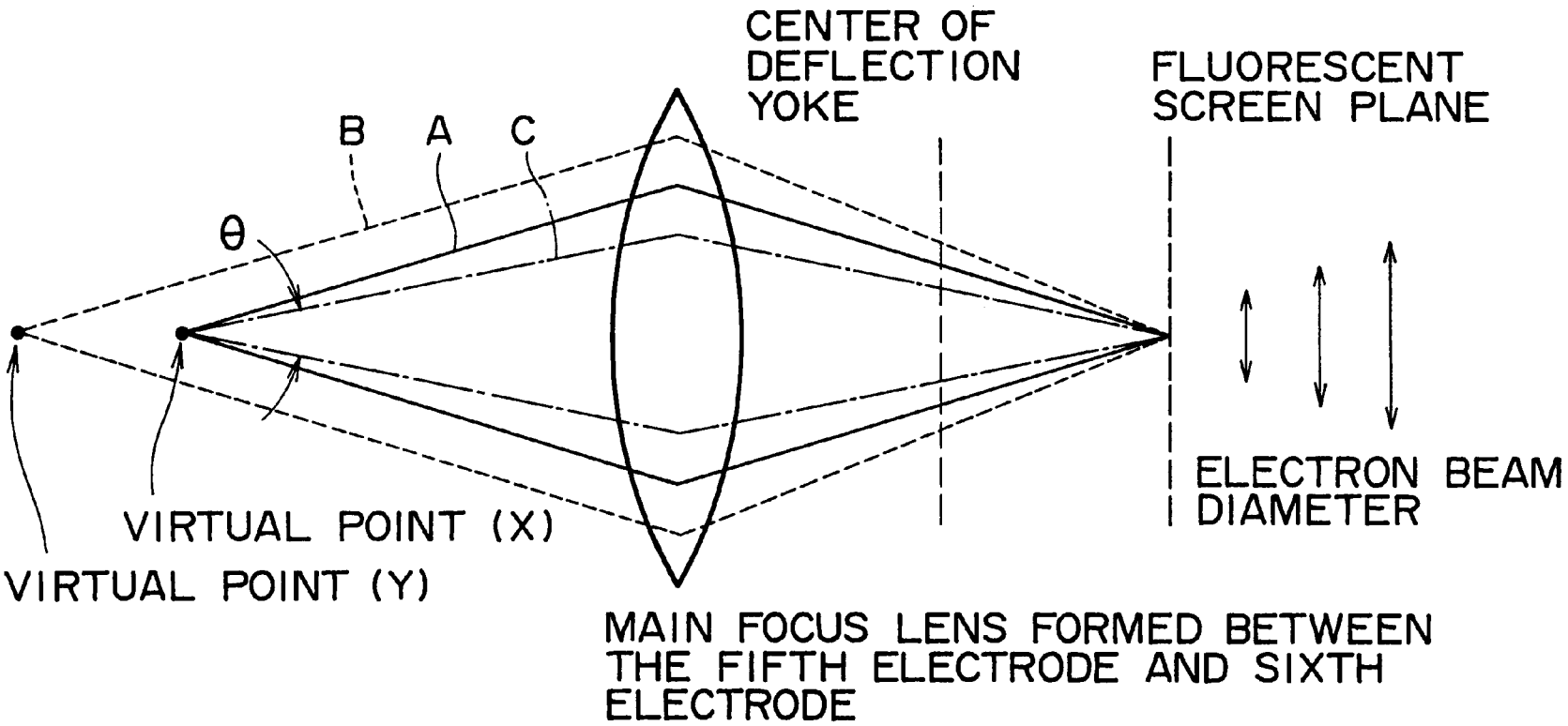
FIG. 16 is a schematic diagram for optically illustrating convergence of electron beams emitted from an imaginary object point on the fluorescent screen with the action of the main focus lens formed between the fifth electrode and sixth electrode.
Figure 17:
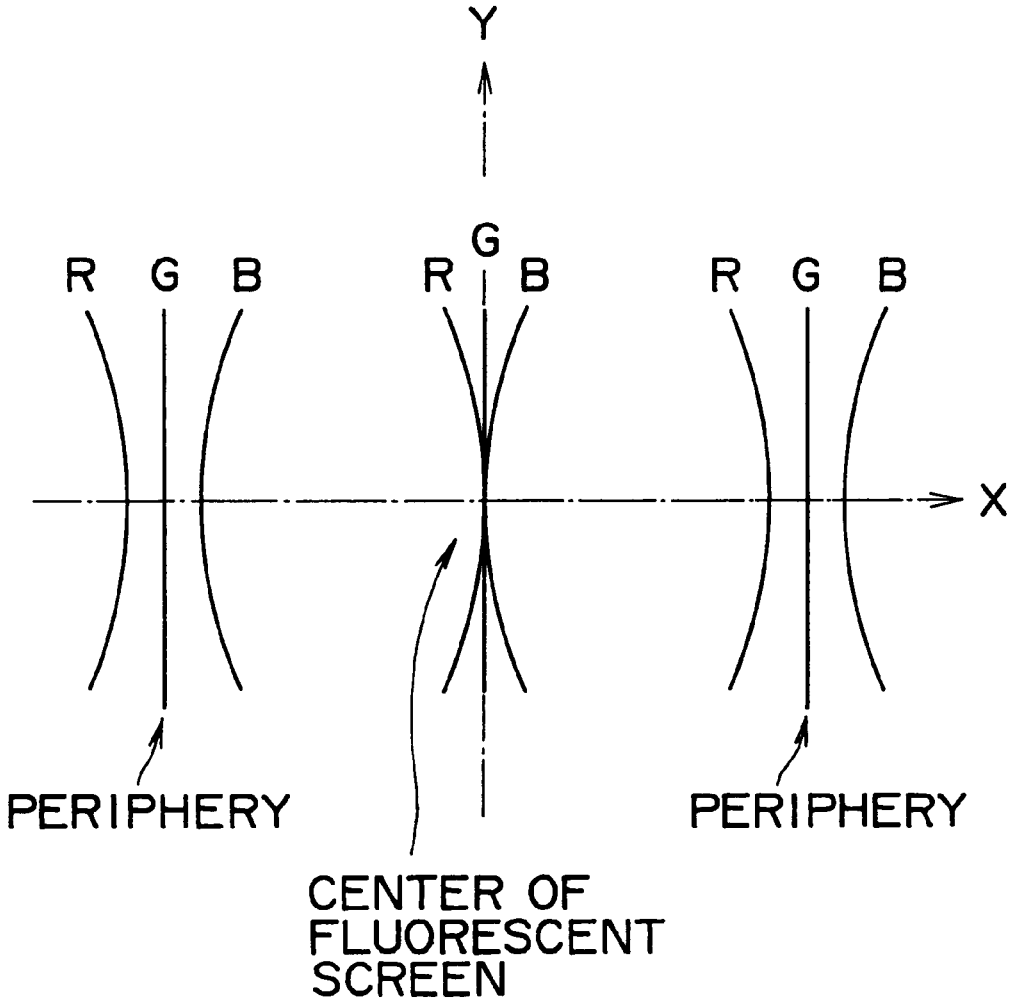
FIG. 17 is a diagram for illustrating convergence.

The embodiments of the present invention have been described based on the example of three-divided focus electrodes, but the focus electrode may be divided into two electrodes, or may be divided into four electrodes. In the case where the focus electrode is divided into two electrodes, various modifications of the existence of astigmatism of the electron beam passage aperture of the respective focus electrodes is shown in FIG. 12. The meaning of characters in FIG. 12 is the same as in FIG. 11. In this case, the focus electrodes are represented with the 2×3 matrix. In this matrix, the first row represents the first focus electrode, and the second row represents the second focus electrode. The electron gun for color cathode ray tubes of the present invention includes a modified embodiment which satisfies the condition that the focus electrode is divided into three electrodes, and for example, as for electron beam passage apertures provided on the first focus electrode and second focus electrodes respectively, the astigmatism of the electron beam passage aperture disposed on the one end side of the focus electrode is different from that of the electron beam passage aperture disposed on the other end side, and the astigmatism of the electron beam passage apertures disposed on the both end sides of this focus electrode is different from that of the electron beam passage apertures disposed on the both end sides of the adjacent focus electrode facing each other, and which has the third focus electrode having electron beam passage apertures of non-astigmatism.

The electron gun for a color cathode ray tube of the present invention is applied to various color cathode ray tube types including, for example, bi-potential focus lens type, uni-potential focus lens type, tri-potential focus lens type, high uni-potential focus lens type, bi-uni-potential focus lens type, and uni-bi-potential focus lens type.

According to the electron gun for color cathode ray tubes of the present invention, beam spot shape of three electron beams can be equalized on the right and left end of the fluorescent screen. As the result, un-clearing of red characters on the right side of the fluorescent screen and un-clearing of blue characters on the left side are prevented consistently. Further, because the beam spot shape of three electron beams can be improved simultaneously, it is not necessary to employ a measure of the electron beam with a small diameter at the magnetic field center of the deflection yoke although such a measure is used in prior art, and it is possible to obtain the beam spot with improved shape over the entire fluorescent screen. Therefore, an electron gun for color cathode ray tubes can be designed without paying particular attention to the electron beam diameter at the magnetic field center of the deflection yoke, and the freedom in designing an electron gun for color cathode ray tubes is maximized. Because electron beam passage apertures disposed at the center of the respective focus electrodes are shielded, the electron beams which pass through such electron beam passage apertures is converged consistently on the fluorescent screen.

I claim:

1. An electron gun for in-line type color cathode ray tubes comprising:

a control electrode, accelerating electrode, and at least two focus electrodes, three electron beam passage apertures provided on each focus electrode, one of said electron beam passage apertures disposed on one end side of at least one focus electrode being different in shape from the electron beam passage aperture disposed on the other end side, said shape being astigmatic; and said electron beam passage apertures disposed on both end sides of the focus electrodes are different in astigmatism from electron beam passage apertures disposed on both sides facing each other of the adjacent focus electrodes.

2. The electron gun for color cathode ray tubes as described in claim 1, wherein the electron beam passage apertures disposed at the center of the respective focus electrodes are shielded by shielding cylinders, said shielding cylinders being out of contact with said passage apertures.

3. The electron gun for color cathode ray tubes as claimed in claim 1, wherein said focus electrode is divided into the first, second, and third electrodes.

4. The electron gun for color cathode ray tubes as claimed in claim 3, wherein a focus voltage is applied to the first and third focus electrodes, a superimposed voltage of a voltage having saw tooth like waveform synchronous with horizontal deflection of the focus voltage and the focus voltage is applied to the second focus electrode, and a quadrupole action is exerted by means of these three electrodes on the electron beams which pass through the electron beam passage apertures.

5. The electron gun for color cathode ray tubes as claimed in claim 4, wherein, when three electron beams impinge on a fluorescent screen of a cathode ray tube, the voltage having saw tooth like waveform exerts divergent action in a perpendicular direction in said quadrupole action on the electron beam impinging on the portion nearer to the end of said fluorescent screen in a horizontal direction, and exerts convergent action in a perpendicular direction in said quadrupole action on the electron beam impinging on the portion farther from the end of said fluorescent screen in said horizontal direction.

6. The electron gun for color cathode ray tubes as claimed in claim 5, wherein, when the electron beam which passes through electron beam passage apertures disposed on one end side of the respective focus electrodes impinges on a portion nearer to the end side of said fluorescent screen of a cathode ray tube in the horizontal direction than the electron beam which passes through electron beam passage apertures disposed on the other end side, a voltage applied to said second focus electrode is higher than the voltage applied to said first and third focus electrodes, and when the electron beam which passes through electron beam passage apertures disposed on the other side of the respective focus electrodes impinges on the portion nearer to the end side of the fluorescent screen of the cathode ray tube in the horizontal direction than the electron beam which passes electron beam passage apertures disposed on the one end side of the respective focus electrodes, a voltage applied to the second focus electrode is lower than a voltage applied to the first and third electrodes.

7. The electron gun for color cathode ray tubes as claimed in claim 4, wherein a shielding cylinder which extends from the electron beam passage aperture disposed at the center of the first focus electrode to the electron beam passage aperture disposed at the center of the third focus electrode is provided in order to shield electron beam passage apertures disposed at the center of the focus electrodes.

8. The electron gun for color cathode ray tubes as claimed in claim 3, wherein electron beam passage apertures disposed on the one end sides of the first and third focus electrodes are formed in vertically long astigmatism, electron beam passage apertures disposed at the center are formed in circular shape, and electron beam passage apertures disposed on the other end sides are formed in horizontally long astigmatism, and the electron beam passage aperture disposed on the one end side of the second focus electrode is formed in horizontally long astigmatism, the electron beam passage aperture disposed at the center is formed in circular shape, and the electron beam passage aperture disposed on the other end side is formed in vertically long astigmatism.

9. The electron gun for color cathode ray tubes as claimed in claim 3, wherein projections are provided on the right and left periphery of electron beam passage apertures disposed on the one end sides of the first and third focus electrodes, electron beam passage apertures disposed at the center are circular, and projections are provided on the top and bottom periphery of electron beam passage apertures disposed on the other end sides, and projections are provided on the top and bottom periphery of the electron beam passage aperture disposed on the one end side of the second focus electrode, the electron beam passage aperture disposed at the center is circular, and projections are provided on the right and left periphery of the electron beam passage disposed on the other end side.

10. The electron gun for color cathode ray tubes as claimed in claim 3, wherein inserting holes are provided on the top and bottom periphery of electron beam passage apertures disposed on the one end sides of the first and third focus electrodes, electron beam passage apertures disposed at the center is circular, and projections are provided on the top and bottom periphery of the electron beam passage apertures disposed on the other end sides, and projections to be inserted into the inserting holes disposed on the one end side of the first and third focus electrodes are provided on the top and bottom periphery of the electron beam passage aperture disposed on the one end side of the second focus electrode, the electron beam passage aperture disposed at the center is circular, and inserting holes into which projections disposed on the other end sides of the first and third focus electrodes are to be inserted are provided on the top and bottom periphery of the electron beam passage aperture disposed on the other end side.

* * * * *